US008220893B2

(12) United States Patent
Suzuki

(10) Patent No.: US 8,220,893 B2
(45) Date of Patent: Jul. 17, 2012

(54) IMAGE FORMING APPARATUS

(75) Inventor: Kousuke Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 350 days.

(21) Appl. No.: 12/699,949

(22) Filed: Feb. 4, 2010

(65) Prior Publication Data

US 2010/0194808 A1 Aug. 5, 2010

(30) Foreign Application Priority Data

Feb. 5, 2009 (JP) ..... 2009-024485

(51) Int. Cl.
*B41J 29/38* (2006.01)

(52) U.S. Cl. ..... 347/14; 347/5; 347/10; 347/11; 347/19

(58) Field of Classification Search ..... 347/5, 10, 347/11, 14, 19
See application file for complete search history.

(56) References Cited

U.S. PATENT DOCUMENTS

| | | | | |
|---|---|---|---|---|
| 5,903,288 | A * | 5/1999 | Yamaguchi | 347/24 |
| 2007/0139455 | A1 * | 6/2007 | Iriguchi | 347/14 |
| 2008/0174632 | A1 | 7/2008 | Miyamoto et al. | |

FOREIGN PATENT DOCUMENTS

| | | | |
|---|---|---|---|
| JP | H04-039051 | A | 2/1992 |
| JP | 2001-179949 | A | 7/2001 |
| JP | 2005-254709 | A | 9/2005 |
| JP | 2006-205463 | A | 8/2006 |
| JP | 2008-080740 | A | 4/2008 |
| JP | 2008-179011 | A | 8/2008 |

OTHER PUBLICATIONS

Japan Patent Office; Notice of Reasons for Rejection for Patent Application No. 2009-024485, mailed Jan. 18, 2011. (counterpart to above-captioned U.S. patent application).

* cited by examiner

*Primary Examiner* — Laura Martin
(74) *Attorney, Agent, or Firm* — Baker Botts L.L.P.

(57) ABSTRACT

The present image forming apparatus converts driving data in such a manner that when a volume of liquid to be ejected in an (m+1)-th print cycle following an m-th print cycle is a maximum volume of ink among a plurality of predetermined volumes of ink, a volume of liquid to be ejected in the m-th print cycle is any volume other than zero and the maximum volume among the predetermined volumes, in which m-th print cycle (m is an integer number no less than "0") no ink is to be ejected.

11 Claims, 13 Drawing Sheets

S: Small
M: Medium
L: Large

S: Small
M: Medium
L: Large

IMAGE FORMING APPARATUS

CROSS REFERENCE TO RELATED APPLICATION

The present application claims priority from Japanese Patent Application No. 2009-24485, which was filed on Feb. 5, 2009, the disclosure of which is herein incorporated by reference in its entirety.

BACKGROUND OF THE INVENTION

1. Field of the Invention

The present invention relates to an image forming apparatus having a liquid ejection head provided with a plurality of nozzles.

2. Description of Related Art

An ejection face of an inkjet head during printing is exposed to the air. Thus, when non-ejection duration in which no ink is ejected is elongated, the viscosity of ink around an ejection opening of the nozzle is likely to increase. Increase in the viscosity of the ink may cause decrease in a volume of ink ejected from the nozzle, which degrades print precision.

Thus, such a technique is known where, in a recording head capable of forming three different sizes of dots per one pixel, when non-ejection duration after a start of printing operation before a first dot is formed exceeds a permitted period of time, the first dot formed by each nozzle is changed from a small dot and a medium dot to a medium dot and a large dot, respectively, the three different sizes of dots being large, medium, and small.

Such a change in the size of a dot is carried out by changing the number of times an ink droplet is ejected from a nozzle per one pixel. This compensates a volume of ink to be ejected from a nozzle which contains ink whose viscosity has increased, that is, a nozzle in which the volume of ink to be ejected is likely to decrease. As a result, a dot having a desired size can be formed. Further, increasing a size of a first dot to be ejected from a nozzle increases the number of times an ink droplet is ejected through the nozzle. This provides a flushing effect.

SUMMARY OF THE INVENTION

According to the above structure, however, such changes as described above are not carried out when a first dot to be formed from a nozzle is the largest dot among the types of dots which can be formed per one pixel, regardless of whether the non-ejection duration exceeds the permitted period of time in the nozzle, the non-ejection duration being after a start of a recording operation before a first dot is formed. In other words, even when the viscosity of the ink increases around a nozzle whose first dot to be formed is a large dot, the expected decrease in the volume of ink to be ejected through the nozzle is not compensated. Thus, a dot of a desired size is not obtained. As a result, print precision is degraded.

The object of the present invention is to provide an image forming apparatus capable of maintaining high print precision even in the event where viscosity of ink has been increased around an ejection opening.

An image forming apparatus of the present invention includes a conveyance mechanism, a liquid ejection head, a driving data storage, a converter, a convert instructor, and a head controller. The conveyance mechanism conveys a recording medium. The liquid ejection head is provided with a plurality of ejection openings arranged at predetermined intervals in a perpendicular direction perpendicular to a conveyance direction in which a recording medium is conveyed by the conveyance mechanism, each of the intervals corresponding to a print resolution in the perpendicular direction. The driving data storage stores therein driving data of the liquid ejection head, the driving data indicating a volume of liquid to be ejected through each of the ejection openings in each print cycle in printing onto one recording medium, the volume of liquid selected from a plurality of different predetermined volumes of ink including "zero," and the print cycle corresponding to a period required for the conveyance mechanism to convey a recording medium for a unit distance corresponding to a print resolution in the conveyance direction. The converter converts the driving data stored in the driving data storage so that, in each of the ejection openings, when a volume of liquid to be ejected in an (m+1)-th print cycle following an m-th print cycle in which no liquid is to be ejected is a maximum volume of ink among the predetermined volumes, the volume of liquid to be ejected in the m-th print cycle being one of the predetermined volumes other than "zero" and the maximum volume, the "m" being an integer number no less than "0." The convert instructor instructs the converter, in a switchable manner, whether to convert the driving data. The head controller controls the liquid ejection head so that each volume of liquid is ejected through each of the ejection openings, based on the driving data stored in the driving data storage including the driving data converted by the converter.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes a preferred first embodiment of the present invention with reference to the figures.

Figure 1:
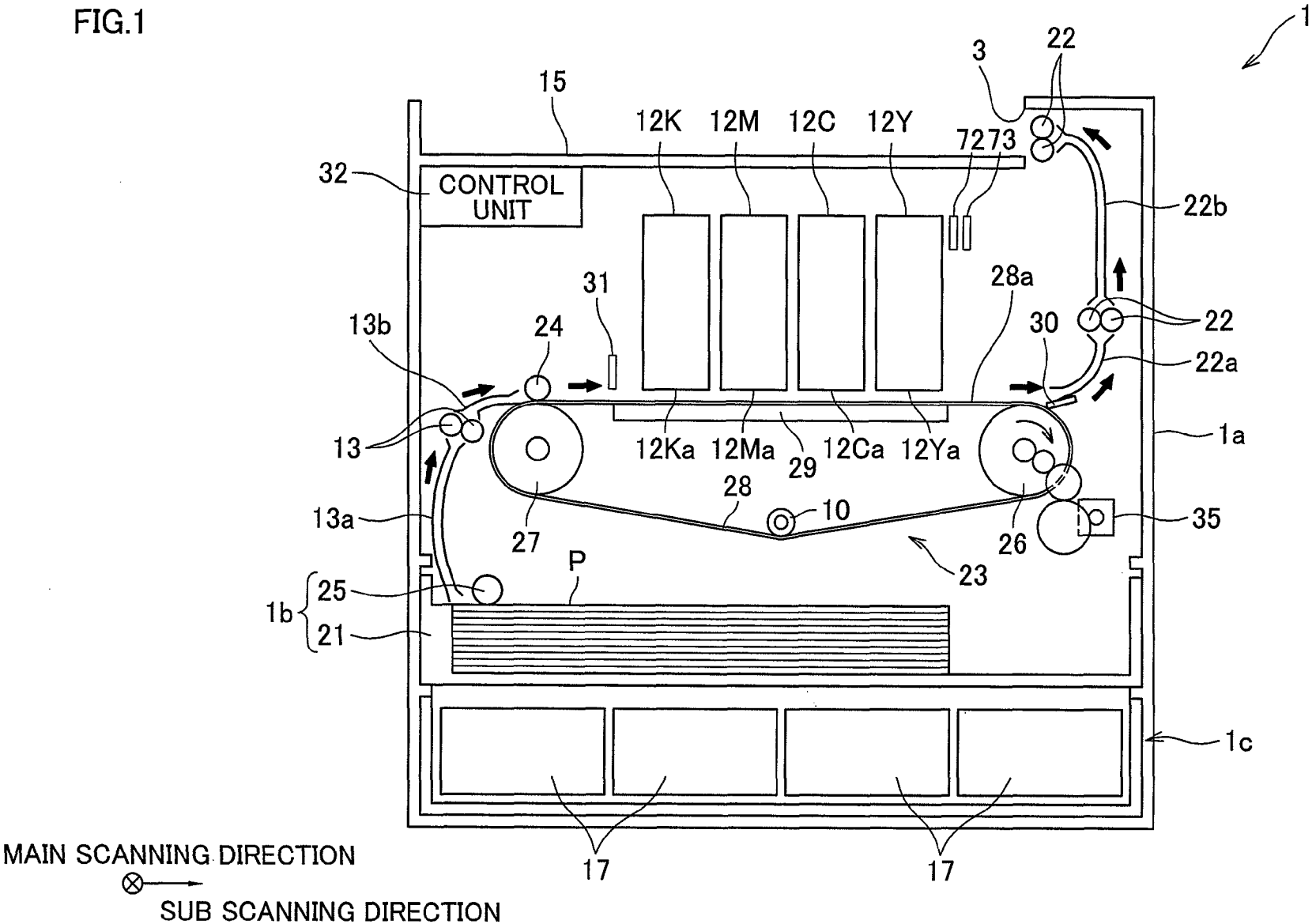
FIG. 1 is a longitudinal sectional view of an internal structure of an inkjet printer according to an embodiment of the present invention, the inkjet printer having an inkjet head.

As illustrated in FIG. 1, an inkjet printer 1 includes a rectangular-parallelepiped shaped housing 1*a*. The housing 1*a* includes: four inkjet heads respectively denoted by 12K, 12M, 12C, and 12Y; and a conveyance mechanism 23. The inkjet heads 12K, 12M, 12C, and 12Y have the same structure as one another, and respectively eject black, magenta, cyan, and yellow ink. The housing 1*a* further includes therein a control unit 32. The control unit 32 controls functions of the inkjet heads 12K, 12M, 12C, and 12Y, and the conveyance mechanism 23. Provided below the conveyance mechanism 23 is a sheet feed unit 1*b* which is detachable from the housing 1*a*. Provided below the sheet feed unit 1*b* is an ink tank unit 1*c* detachable from the housing 1*a*.

The inkjet printer 1 includes therein a sheet conveyance path formed from the sheet feed unit 1*b* to a sheet exit unit 15, along the bold arrows illustrated in FIG. 1. Through the sheet conveyance path, a sheet P is conveyed. The sheet feed unit 1*b* includes a sheet feed tray 21 and a sheet feed roller 25. The sheet feed tray 21 has a box shape which is open upward. The sheet feed tray 21 stores a plurality of sheets P stacked therein. The sheet feed roller 25 sends out the uppermost sheet P in the sheet feed tray 21. The sheet P sent out is guided by guides 13*a* and 13*b*, and a feed roller pair 13, to be advanced to the conveyance mechanism 23.

The conveyance mechanism 23 includes two belt rollers respectively denoted by reference numerals 26 and 27, a conveyor belt 28, a tension roller 10, and a platen 29. The conveyor belt 28 is an endless belt looped around the rollers 26 and 27. The tension roller 10 is biased downward, and contacts an inner circumferential face of a lower part of the conveyor belt 28. The tension roller 10 thus applies tension to the conveyor belt 28. The platen 29 is located facing the inkjet heads 12K, 12M, 12C, and 12Y, in a region surrounded by the conveyor belt 28. The platen 29 supports the conveyor belt 28 from below. This prevents the conveyor belt 28 from deforming downward. The belt roller 26, which is a drive roller, rotates clockwise in FIG. 1 by drive force applied from the conveyor motor 35 to a shaft of the belt roller 26. The belt roller 27, which is a driven roller, rotates clockwise in FIG. 1 as the conveyor belt 28 runs as the belt roller 26 rotates. Note that the drive force of the conveyor motor 35 is transmitted to the belt roller 26 through a plurality of gears.

The outer circumferential face 28*a* of the conveyor belt 28 is treated with silicone to have adhesion. A nip roller 24 is provided opposite the belt roller 27. The nip roller 24 presses a sheet P against the outer circumferential face 28*a* of the conveyor belt 28, the sheet P being sent from the sheet feed unit 1*b*. The sheet P pressed against the outer circumferential face 28*a* is conveyed in a sheet conveyance direction while the sheet P is kept on the outer circumferential face 28*a* by the adhesion. Note that the sheet conveyance direction is a direction towards the right in FIG. 1, and also referred to as a sub scanning direction.

Provided opposite the belt roller 26 is a peel plate 30 which peels the sheet P from the outer circumferential face 28*a*. The sheet P peeled is conveyed while it is guided by guides 22*a* and 22*b*, and two pairs of discharge rollers 22. The sheet P is then discharged through an exit opening 3 to the sheet exit unit 15, the exit opening 3 provided to an upper part of the housing 1*a*, and the sheet exit unit 15 provided on an upper face of the housing 1*a*.

The four inkjet heads 12K, 12M, 12C, and 12Y respectively eject black, magenta, cyan, and yellow ink. The four inkjet heads 12K, 12M, 12C, and 12Y each have a substantial rectangular-parallelepiped shape long in a main scanning direction. The main scanning direction is perpendicular to the conveyance direction, in which conveyance direction the sheet P is conveyed. The four inkjet heads 12K, 12M, 12C, and 12Y are fixed to line up in the sub scanning direction. The sub scanning direction is parallel to the conveyance direction of the sheet P. In other words, the printer 1 is a line printer.

Bottom faces of the inkjet heads 12K, 12M, 12C, and 12Y respectively serve as ejection faces 12Ka, 12Ma, 12Ca, and 12Ya, on each of which ejection faces a plurality of ejection openings 108 are provided. When the sheet P being conveyed passes immediately below the four inkjet heads 12K, 12M, 12C, and 12Y, ink of respective colors is ejected through the ejection openings 108 towards an upper face of the sheep P. Hence, dots are formed on the upper face of the sheet P serving as a print face, and a desired color image is thus formed.

The inkjet heads 12K, 12M, 12C, and 12Y are respectively connected to four ink tanks 17 located in the ink tank unit 1*c*. The ink tanks 17 store therein different colors of ink, respectively. The ink tanks 17 respectively supply ink to the inkjet heads 12K, 12M, 12C, and 12Y through tubes.

Provided between the inkjet head 12K and the nip roller 24 is a sheet sensor 31 which is a reflective optical sensor, the inkjet head 12K being the most upstream inkjet head among the four inkjet heads. The sheet sensor 31 outputs a detection signal when a leading end of a sheet being conveyed in the conveyance path has reached immediately below the sheet sensor 31.

Further, provided slightly more downstream than the inkjet head 12Y are a temperature sensor 72 and a humidity sensor 73, the inkjet head 12Y being the most downstream inkjet head among the four inkjet heads. The temperature sensor 72 is capable of detecting temperature around the four inkjet heads (hereinafter also referred to as ambient temperature). The humidity sensor 73 is capable of detecting humidity around the four inkjet heads (hereinafter also referred to as ambient humidity). The temperature sensor 72 and the humidity sensor 73 respectively output the detected temperature and humidity to the control unit 32. Note that the present embodiment utilizes only the humidity sensor 73 out of the temperature sensor 72 and the humidity sensor 73. However, only the temperature sensor 72 instead, or both the humidity sensor 73 and the temperature sensor 72 may be utilized.

Figure 2:
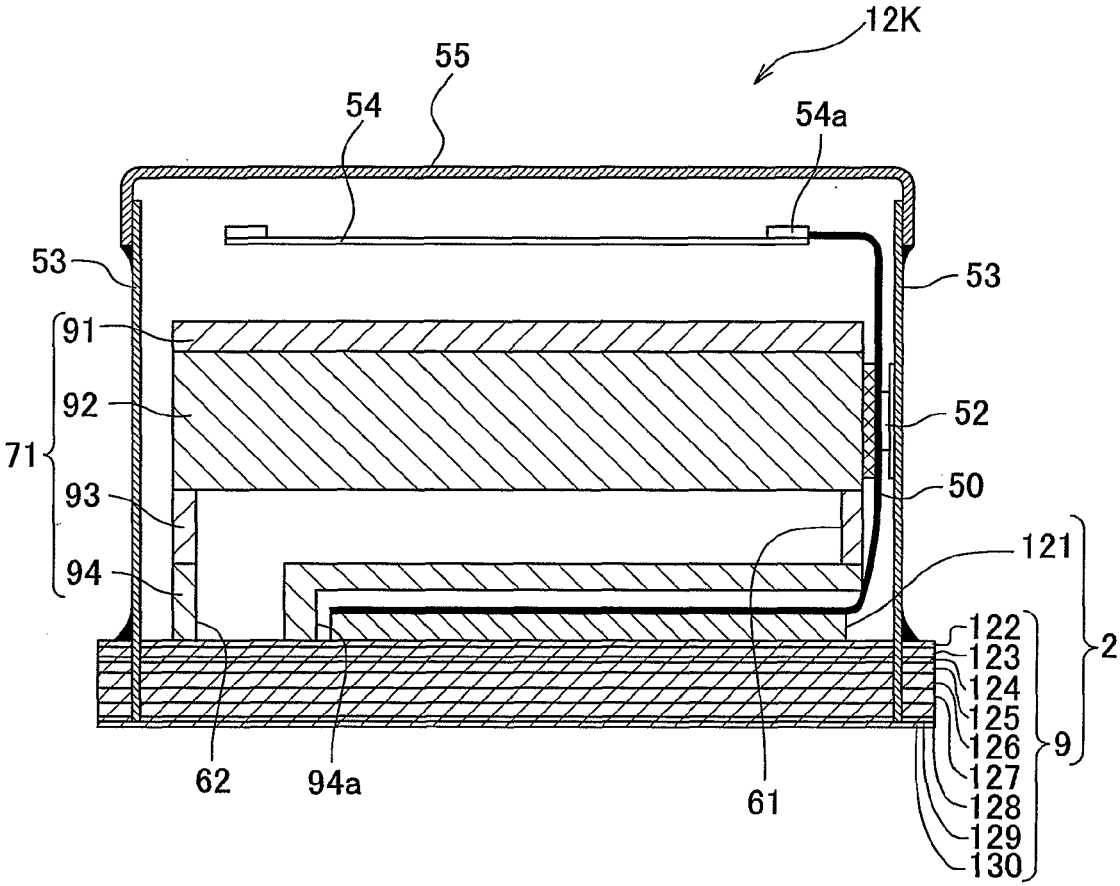
FIG. 2 is a longitudinal sectional view of the inkjet head illustrated in FIG. 1.

The following describes the inkjet heads 12K, 12M, 12C, and 12Y in detail with reference to FIG. 2. Note that the following describes solely the inkjet head 12K since the inkjet heads each have the same structure. As illustrated in FIG. 2, the inkjet head 12K includes a head main body 2, a reservoir unit 71, a COF (Chip on Film) 50 which is a flat flexible substrate, a control substrate 52, and a cover. The head main body includes a passage unit 9 having passages formed therein, and actuator units 121 for ejecting ink. The COF 50 is implemented with a driver IC 52, and electrically connects the actuator units 121 and the control substrate 54 with one another. The cover includes a side cover 53 and a head cover 55. Further, the cover and the passage unit 9 encase the actuator units 121, the reservoir unit 71, the COF 50 and the control substrate 54. The cover prevents intrusion of inkmist from outside.

The reservoir unit 71 is composed of four plates 91 to 94 laminated. The reservoir unit 71 includes therein a not-illustrated ink inflow passage, an ink reservoir 61, and ten ink outflow passages 62 communicating with one another. Note that FIG. 2 illustrates only one ink outflow passage 62. The ink stored in the ink reservoir 61 is supplied to the passage unit 9 through the ink outflow passages 62 and ink supply openings 105*b* illustrated in FIG. 3. Further, the plate 94 has a plurality of protrusions 94*a* which include the ink outflow passages 62. The reservoir unit 71 and the passage unit 9 are connected with one another at the protrusions 94*a*. The protrusions 94*a* included in the plate 94 create a void between the plate 94 and the passage unit 9. In the void, the four actuator units 121 are provided. Note however that FIG. 2 illustrates only one of the four actuator units.

The COF 50 has parts jointed to the actuator units 121, and parts extending upward between the side cover 53 and the reservoir unit 71. The COF 50 has a plurality of not-illustrated wires formed thereon. One end of each of the wires is electrically connected to a later-described individual electrode 135 and a later-described common electrode 134 on a joint face which is an upper face of the actuator unit 121. The other end of each of the wires is connected to an electric component on the control substrate 54 via the connector 54*a*.

The control substrate 54 outputs a control signal from a not-illustrated superordinate control device to the driver IC 52. The driver IC 52 generates a drive signal for driving the actuator unit 121.

Figure 3:
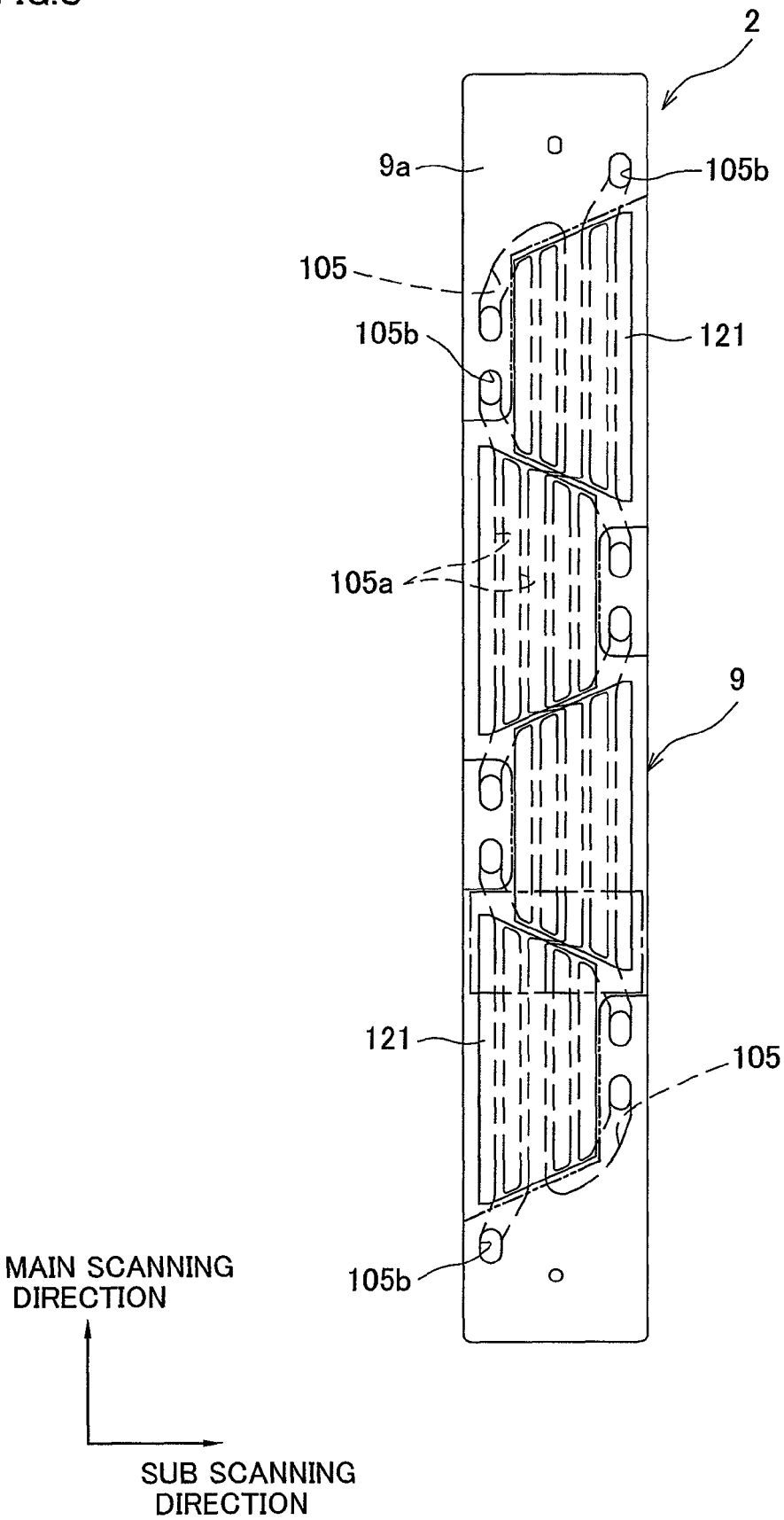
FIG. 3 is a plan view of the inkjet head illustrated in FIG. 1.

The following describes the head main body 2. The head main body 2 includes a passage unit 9, and four actuators 121 fixed to an upper face 9*a* of the passage unit 9, as illustrated in FIG. 3.

Figure 4:
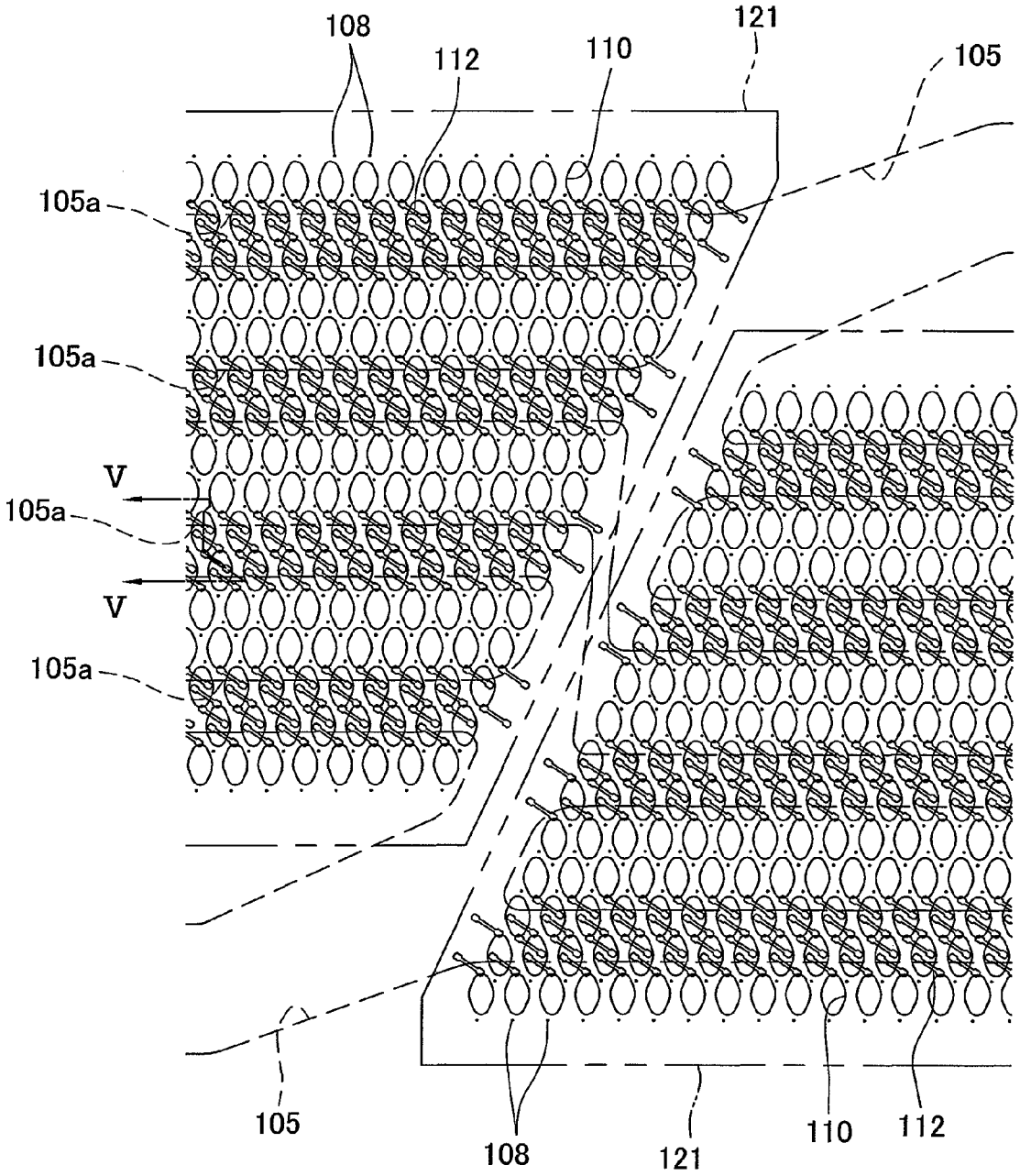
FIG. 4 is a magnified view of the region illustrated with the dashed line in FIG. 3.
Figure 5:
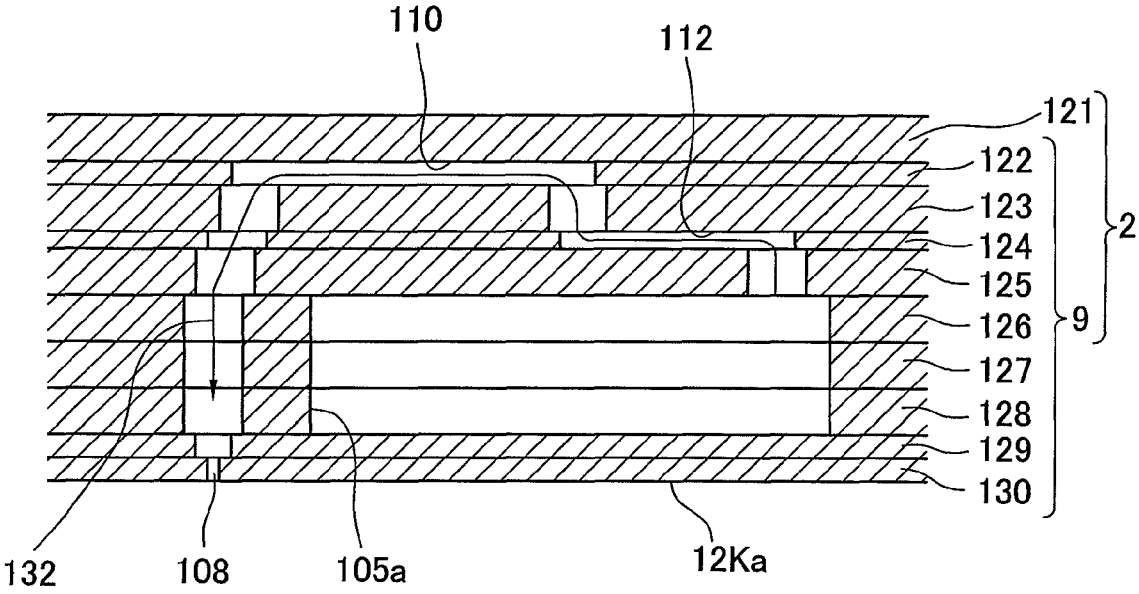
FIG. 5 is a cross-sectional view taken along the V-V line in FIG. 4.

The passage unit 9 has a rectangular parallelepiped shape, and exhibits substantially the same shape as the plate 94 of the reservoir unit 71. The upper face 9*a* of the passage unit 9 is provided with ten ink supply openings 105*b* each corresponding to an ink outflow passage 62 of the reservoir unit 71. The passage unit 9 is provided with manifold passages 105 and sub manifold passages 105*a* therein, as illustrated in FIGS. 3 and 4. The manifold passages 105 communicate with ink supply openings 105*b*. The sub manifold passages 105*a* serving as common ink chambers branch off from the manifold passages 105. FIG. 4 illustrates pressure chambers 110, apertures 112, and the ejection openings 108 with solid lines, although they are supposed to be illustrated with broken lines since they are located beneath the actuator units 121. A lower face of the passage unit 9 serves as the ejection face 12Ka where a plurality of ejection openings 108 are provided in a matrix, as illustrated in FIGS. 4 and 5. A fix face of the passage unit 9 on which the actuator units 121 are fixed is provided with a plurality of pressure chambers 110 arranged in a matrix in the same manner as the ejection openings 108.

In the present embodiment, the actuator units 121 each have sixteen parallel pressure chamber columns extending in a longitudinal direction of the passage unit 9, the pressure chamber columns provided at equal intervals with respect to a width direction of the passage unit 9. Each of the pressure chamber columns has a plurality of pressure chambers 110. A pressure chamber column closer to a longer side of each of the actuator units 121 has more pressure chambers 110 than a pressure chamber column closer to a shorter side thereof does, so as to conform to the trapezoidal shape of the actuator unit 121. The ejection openings 108 are arranged in the same manner.

As illustrated in FIG. 5, the passage unit 9 is composed of nine metal plates, in the following order from the top: a cavity plate 122; a base plate 123; an aperture plate 124; a supply plate 125; manifold plates 126, 127, and 128; a cover plate 129; and a nozzle plate 130. The plates 122 to 130 are each long in the main scanning direction, and have a rectangular shape in plan view. The plates 122 to 130 are aligned and laminated so as to form in the passage unit 9 the manifold passages 105, the sub manifold passages 105*a*, and a plurality of individual ink passages 132, each of which individual ink passages 132 runs from an exit of a sub manifold passage 105*a* through a pressure chamber 110 to an ejection opening 108.

The following describes flow of ink in the passage unit 9. The ink supplied from the reservoir unit 71 to the passage unit 9 through the ink supply openings 105*b* is distributed from the manifold passages 105 to the sub manifold passages 105*a*. The ink in the sub manifold passages 105*a* flows into each of the individual ink passages 132, and reaches a corresponding ejection opening 108 through a corresponding aperture 112 and a corresponding pressure chamber 110, the aperture 112 serving as a throttle.

The following describes the actuator units 121. As illustrated in FIG. 3, the four actuator units 121 each have a trapezoidal shape in plan view, and are arranged in staggered fashion in the main scanning direction so as to avoid the ink supply openings 105*b*. Further, a pair of parallel opposed sides of each of the actuator units 121 extend in the longitudinal direction of the passage unit 9. An oblique side of an actuator unit 121 and an oblique side of an adjacent actuator unit 121 overlap each other with respect to the main scanning direction of the passage unit 9.

Figure 6A:
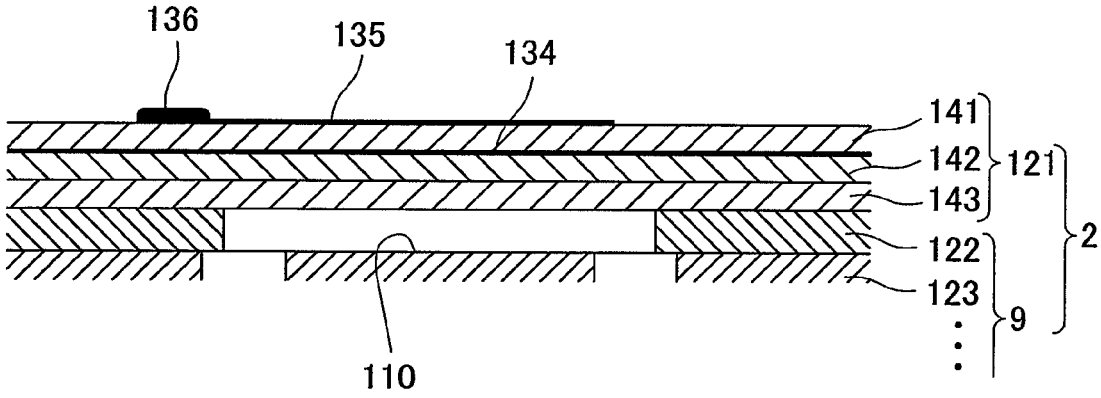
FIG. 6 is a partial cross-sectional view and a partial plan view of the actuator unit included in the inkjet head.

As illustrated in FIG. 6A, each of the actuator units 121 is composed of three sheet piezoelectric layers 141 to 143 made of a lead-zirconate-titanate (PZT)-based ceramic material having ferroelectricity. A surface of the piezoelectric layer 141; i.e., the joint face of the actuator unit 121 has individual electrodes 135 provided thereon, each of the individual electrodes 135 facing a pressure chamber 110. Sandwiched by the piezoelectric layer 141 and the piezoelectric layer 142 thereunder is the common electrode 134 formed on an entire surface of the piezoelectric layer 142.

Figure 6B:
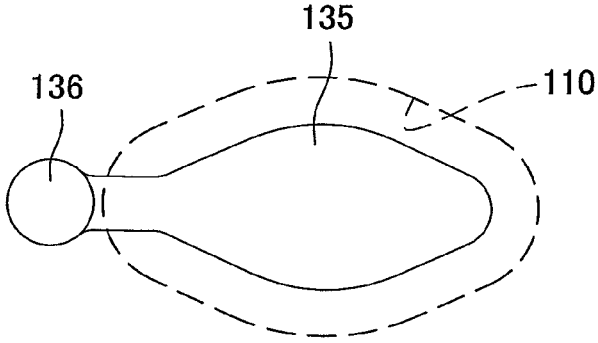

As illustrated in FIG. 6B, each of the individual electrodes 135 has a substantial rhombic shape in plan view, similar to the pressure chambers 110. Most part of each of the individual electrodes 135 is located within a corresponding pressure chamber 110 in plan view. One acute angle portion of each of the substantial rhombic individual electrodes 135 extends outside the pressure chamber 110, and is provided with a circular individual land 136 at a leading end thereof. The circular individual land 136 is electrically connected to the corresponding individual electrode 135. The individual lands 136 are thicker than the individual electrodes 135.

The common electrode 134 is grounded so as to allow equal application of a reference potential to the parts of the common electrode 134 corresponding to the pressure chambers 110. The individual electrodes 135, on the other hand, are each electrically connected to one of a plurality of terminals of the driver IC 52 via an individual land 136 and an internal wire of the COF 50. Thus, the driver IC 52 selectively supplies a driving signal to one or more desired individual electrodes 135. In other words, the parts of the actuator unit overlapping the individual electrodes 135 in plan view each function as an individual actuator. That is, the actuator unit 121 is configured with the same number of actuators as the pressure chambers 110.

The following describes a driving method of the actuator units 121. The piezoelectric layer 141 is polarized in its width direction. The piezoelectric layers 142 and 143, to the contrary, are inactive layers which do not deform spontaneously. The piezoelectric layers 141 to 143 are fixed on an upper face of the cavity plate 122 which define the pressure chambers 110. When the individual electrodes 135 and the common electrode 134 are set at different potentials, and an electric field is impressed on the piezoelectric layer 141 in its polarization direction, part of the piezoelectric layer 141 deforms as a result. This causes the part of the piezoelectric layer 141 to function as an active portion, on which part the electric field is imposed. When the electric field occurs in the same direction as the polarization, the active portion expands in its thickness direction and shrinks in its surface direction. Accordingly, the part of the piezoelectric layer 141 and the piezoelectric layers 142 and 143 thereafter exhibit different strains in the surface direction. As a result, the piezoelectric layers 141 to 143 as a whole deform toward the pressure chambers 110 into a convex shape; i.e., present a unimorph deformation. This applies pressure as ejection energy to ink inside the pressure chambers 110 to create a pressure wave in the pressure chambers 110. The pressure wave generated propagates from a pressure chamber 110 to the corresponding ejection opening 108 to eject an ink droplet through the ejection opening 108.

In the present embodiment, the individual electrodes 135 are kept at a predetermined positive potential. Each time an ejection request is addressed, the ground potential is applied to the individual electrodes 135 once, and then the driver IC 52 outputs, at predetermined timing, a pulse which causes the predetermined positive potential to be applied again to the individual electrodes 135 (see FIGS. 8A to 8C). In this case, at timing when the individual electrodes 135 are given the ground potential, the pressure of ink decreases, causing the ink to be sucked from the sub manifold passages 105*a* to the individual ink passages 132. Afterwards, at timing when the individual electrodes 135 are given the predetermined potential, the pressure of ink inside the pressure chambers 110 increases, causing an ink droplet to be ejected through the ejection openings 108. In other words, a rectangular wave pulse is applied to the individual electrodes 135. A pulse width is substantially equal to an AL (acoustic length) which is a length of time required for a pressure wave generated in a pressure chamber 110 to propagate from an exit of the sub manifold passage 105*a* to a leading end of the corresponding ejection opening 108. This allows a positive pressure wave which has been reflected, with its phase reversed, from the exit of the sub manifold passage 105*a*, to overlap, in the pressure chamber 110, a positive pressure which is newly imposed from the actuator unit 121. Thus, a large pressure is imposed on the ink inside the pressure chamber 110.

Figure 7:
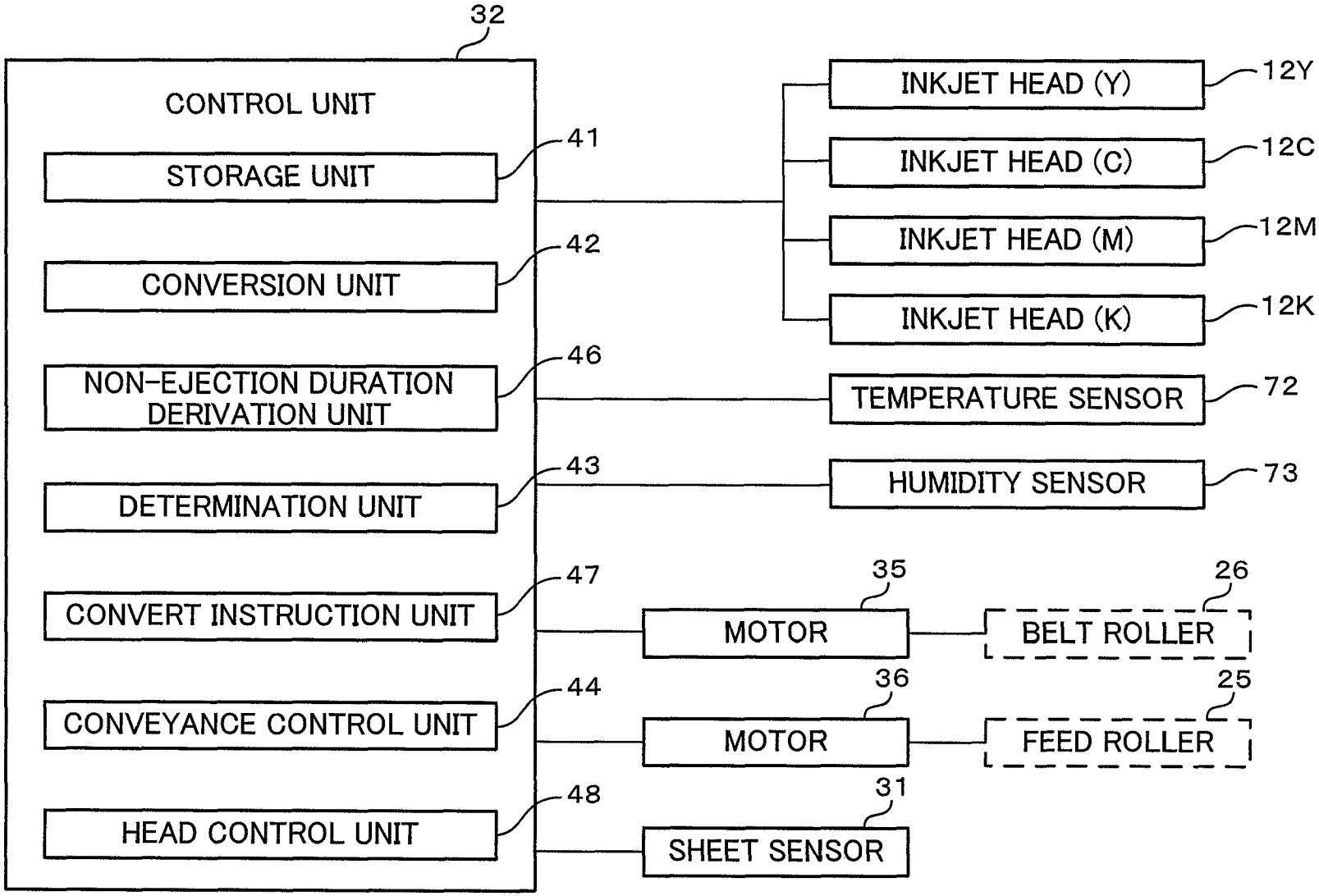
FIG. 7 is a function block diagram of the inkjet printer illustrated in FIG. 1.

As illustrated in FIG. 1, the inkjet printer 1 includes the control unit 32. The control unit 32 controls a function of each part of the inkjet printer 1. The control unit 32 is configured with a plurality of types of hardware such as a CPU (Central Processing Unit), a RAM (Random Access Memory), and a ROM (Read Only Memory). The ROM stores therein various types of software which controls the inkjet printer 1. The software and the hardware in the control unit 32 cooperate with one another to build, in the control unit 32, a storage unit 41, a conversion unit 42, a non-ejection duration derivation unit 46, a determination unit 43, a convert instruction unit 47, a conveyance control unit 44, and a head control unit 48, as illustrated in FIG. 7. In the present embodiment, the control unit 32 includes electric components on the control substrate 54, and the driver IC 52.

The storage unit 41 serving as a driving data storage stores driving data for each color, the driving data instructing the color and the size of a dot to be formed on a sheet P. The driving data is constituted based on image data sent from a not-illustrated host computer, such as bitmap data and jpeg data, the image data corresponding to a color image to be formed. The driving data includes ink volume information corresponding to the size of a pixel dot to be formed, the ink volume information indicating a volume of ink to be ejected in each print cycle. Here, a print cycle is defined as a period of time required to convey a sheet P for a unit distance corresponding to a print resolution in the sub scanning direction. Further, in the present embodiment, a volume of ink to be ejected through each of the ejection openings 108 is one of a "large volume," a "medium volume," a "small volume," and a "no volume" illustrated in FIG. 9, respectively containing 21 pl, 14 pl, 7 pl, and 0 pl of ink. For the sake of convenience, the following describes solely a process carried out with respect to the inkjet head 12K, on the premise that the inkjet head 12K alone ejects ink. Nevertheless, the process same as the one described below is carried out with respect to the inkjet heads 12M, 12C, and 12Y, as well.

The conversion unit 42 serving as a converter is capable of converting the driving data of the inkjet head 12K stored in the storage unit 41 as follows. (1) For each of the ejection openings 108 of the inkjet head 12K, the conversion unit 42 converts driving data so that when "large volume" of ink is to be ejected in a first print cycle, that is, in a later-described case where "m" equals "0," any volume of ink other than "no volume" or "large volume" of ink is ejected through the ejection opening 108 in a 0-th print cycle which precedes the first print cycle. Note that the first print cycle is a print cycle corresponding to a start of printing onto a sheet P, that is, a print cycle where ink can be ejected through the ejection openings 108 of the inkjet head 12K to a first dot-formable position in a print area on the sheet P which is being conveyed on the conveyor belt 28. The first dot-formable position is a dot-formable position closest, in the sub scanning direction, within the print area to a leading end of the sheet P. Specifically, the first print cycle corresponds to later-described grid cells (1, 1) to (1,8) shown in FIG. 12A. Accordingly, ejecting ink through the ejection openings 108 in the 0-th print cycle refers to ejecting ink onto a margin around the print area on the sheet P. Further, when a maximum volume of ink; i.e., "large volume" of ink is to be ejected in an (m+1)-th print cycle following an m-th print cycle where no ink is to be ejected, driving data is converted in such a manner that any volume of ink other than "no volume" or "large volume" of ink is ejected in the m-th print cycle. Note that the "m" is an integer number no less than "0." In the present embodiment, the driving data is converted so that "small volume" or "medium volume" of ink is to be ejected in the m-th print cycle, based on a result of determination of whether non-ejection duration is no shorter than a predetermined period of time. (2) For each of the ejection openings 108, the conversion unit 42 converts driving data so that a volume of ink to be ejected in a n-th print cycle other than "no-volume" or "large volume" is changed to a volume of ink larger than the original volume of ink. Note that the "n" is a natural number. In the present embodiment, the driving data is converted in such manners that: (i) when "medium volume" of ink is to be ejected in the n-th print cycle, "large volume" of ink is ejected instead; and (ii) when "small volume" of ink is to be ejected in the n-th print cycle, "medium volume" or "large volume" of ink is ejected instead, according to whether humidity determined by a later-described determination unit 43 is no lower than a predetermined humidity. Note that when the temperature sensor 72 is to be utilized, the driving data may be converted so that either "medium volume" or "large volume" of ink is to be ejected in the n-th print cycle, according to whether the later-described determination unit 43 determines that the temperature is no lower than a predetermined temperature.

The non-ejection duration derivation unit 46 serving as a non-ejection duration deriver is capable of deriving non-ejection duration from a last ejection of ink from the inkjet head 12K to each print cycle in printing onto a sheet P. In the present embodiment, a non-ejection duration is defined as a period of time which has elapsed since printing on the preceding sheet P has completed. More specifically, the non-ejection duration derivation unit 46 derives, after receiving a detection signal indicating a leading end of the preceding sheet P outputted by the sheet sensor 31, a period of time which has elapsed after a predetermined period of time required to complete printing on a sheet P before the start of printing on the current sheet P. As a modification, for example, the non-ejection derivation unit 46 may derive non-ejection duration, for each of the ejection openings 108 of the inkjet head 12K, after a last ejection of ink from the ejection opening 108 to a start of each print cycle of printing on a sheet P.

The determination unit 43 serving as a first determiner determines whether non-ejection duration derived by the non-ejection duration derivation unit 46 is no shorter than a predetermined period of time. The predetermined period of time is thirty seconds in the present embodiment. Note that the predetermined period of time is determined in accordance with properties of the ink. Specifically, the predetermined period of time is a period of time which has elapsed before apparent changes in print precision or print quality occur, the changes caused by changes in the ink properties which occur as changes in the viscosity or properties of the ink progress. Note that in the present embodiment, the predetermined period of time is determined based on an outcome of an observation, which is made under the microscope, of changes in the shape of a dot as a result of increase in viscosity of the ink, which ink is left for various periods of time.

The determination unit 43 may be capable of setting the predetermined period of time so that the predetermined period of time increases as the ambient humidity received from the humidity sensor 73 increases. This takes into account the fact that the viscosity of the ink is less likely to increase as the ambient humidity increases. Further, the determination unit 43 determines whether the ambient humidity is no lower than the predetermined humidity. The present embodiment utilizes only the humidity sensor 73. However, when the temperature sensor 72 is to be utilized, the predetermined period of time may be set in such a manner that the predetermined period of time is elongated as the ambient temperature received from the temperature sensor 72 decreases. This takes into account the fact that the viscosity of the ink is less likely to increase as the ambient temperature decreases. When the temperature sensor 72 is utilized, the determination unit 43 determines whether the temperature received by the temperature sensor 72 is no lower than the predetermined temperature.

The convert instruction unit 47 serving as a convert instructor instructs the conversion unit 42 to convert driving data so that object data included in the driving data is converted, which object data corresponds to (i) each of a first predetermined number of print cycles from the print cycle corresponding to a start of printing onto a sheet P, and (ii) each of a first predetermined number of print cycles after a second predetermined number of consecutive print cycles, in which second predetermined number of consecutive print cycles no ink is to be ejected. Note that both the first predetermined number and the second predetermined number are "three" in the present embodiment.

The conveyance control unit 44 controls the motor 35 and the motor 36, which drive the belt roller 26 and the feed roller 25, respectively.

While synchronizing with control of the motor 35 by the conveyance control unit 44, the head control unit 48 controls the inkjet head 12K in such a manner that the ejection openings 109 of the inkjet head 12K each eject a predetermined volume of ink, based on (i) a detection signal from the sheet sensor 31 indicating the leading end of a sheet P, and (ii) driving data stored in the storage unit 41. The same control is performed on other inkjet heads, and thus a desired color image is formed on a sheet P.

Figure 8A:
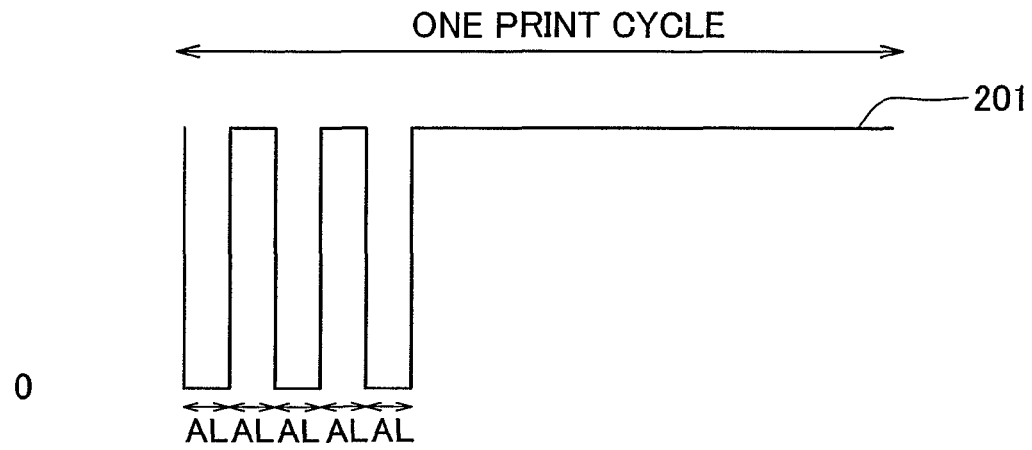
FIG. 8 is a schematic diagram of three ejection waveforms stored in the ejection control unit illustrated in FIG. 7.
Figure 8B:
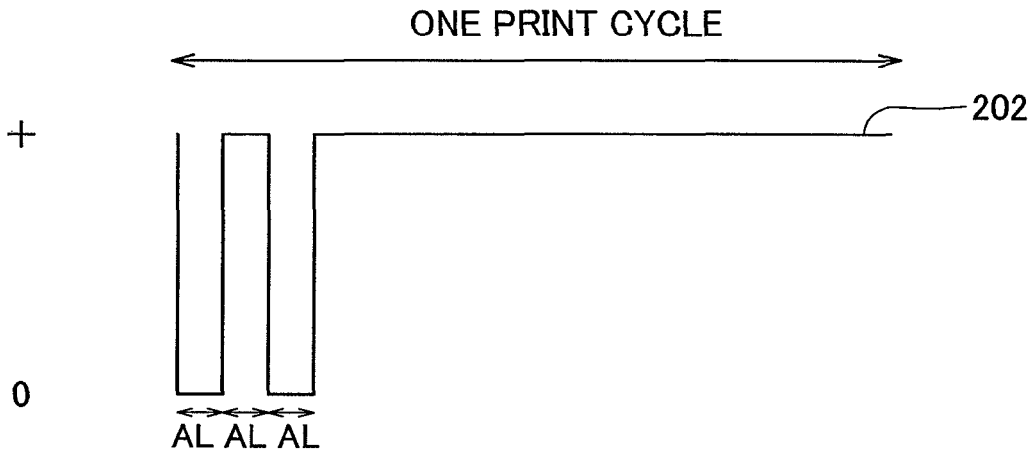
Figure 8C:
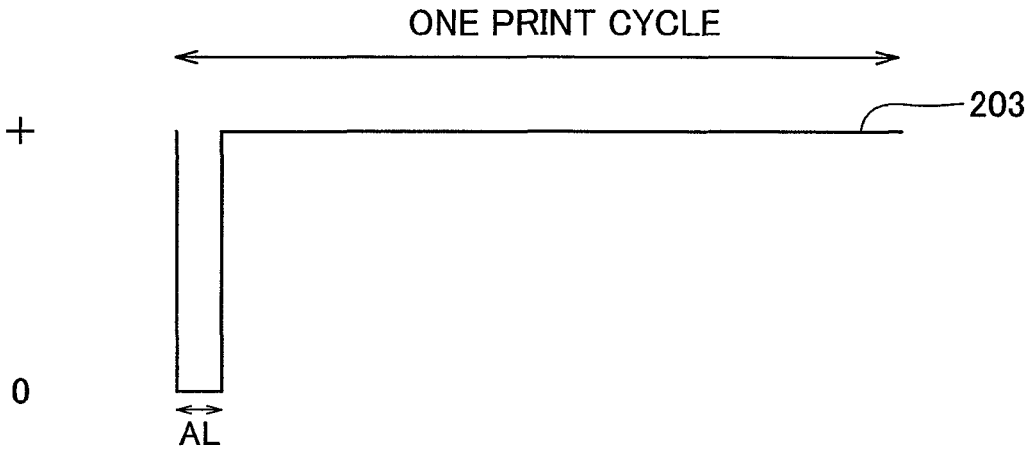

The following describes ejection of different volumes of ink, with reference to FIGS. 8 and 9. In the present embodiment, the head control unit 48 stores therein three types of ejection waveforms as illustrated in FIGS. 8A to C. For each print cycle, the head control unit 48 outputs, from the driver IC 52 to each of the individual electrodes 135, one of the ejection waveforms as a pulse train signal amplified to a predetermined positive potential according to corresponding ink volume information. This causes unimorph deformation in each of the actuators, thus ejecting an ink droplet of the predetermined volume.

Figure 9A:
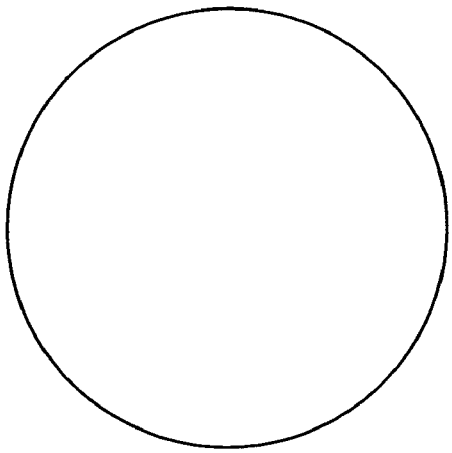
FIG. 9 is a schematic view illustrating the shapes of ink droplets ejected by each of the three ejection waveforms illustrated in FIG. 8 when the ink droplets land.

FIG. 8A illustrates an ejection waveform 201 representing ejection of "large volume" of ink. The ejection waveform 201 includes three ejection pulses each having a width equal to the AL. One or more ink droplets are ejected by each pulse. A total volume of ink ejected by these three pulses is "large volume" of ink. The distance between each of the three pulses equals the AL. This allows ejection of one or more ink droplets by each pulse, which droplets are merged on a sheet P to form one pixel dot corresponding to "large volume" of ink. FIG. 9A indicates a large dot formed on a sheet P, the large dot corresponding to "large volume" of ink.

Figure 9B:
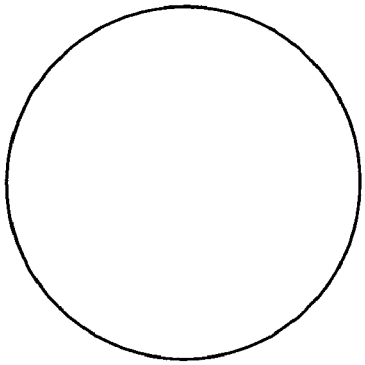

FIG. 8B illustrates an ejection waveform 202 representing ejection of "medium volume" of ink. The ejection waveform 202 includes two ejection pulses each having a width equal to the AL. One or more ink droplets are ejected by each pulse. A total volume of ink ejected by these two pulses is "medium volume" of ink. The distance between the two pulses equals the AL. This allows ejection of one or more ink droplets by each pulse, which droplets are merged on a sheet P to form one pixel dot corresponding to "medium volume" of ink. FIG. 9B indicates a medium dot formed on a sheet P, the medium dot corresponding to "medium volume" of ink.

Figure 9C:
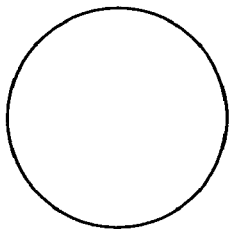

FIG. 8C illustrates an ejection waveform 203 representing ejection of "small volume" of ink. The ejection waveform 203 includes one ejection pulse having a width equal to the AL. The volume of ink ejected by this pulse is "small volume" of ink. FIG. 9C indicates a small dot formed on a sheet P, the small dot corresponding to "small volume" of ink.

Note that a cancel pulse serving as a stabilizer pulse may be added after the last pulse in each of the pulse waveforms illustrated in FIGS. 8A to C. The cancel pulse has a narrower width than an ejection pulse, and does not cause any ejection of ink. The cancel pulse functions so as to restrain pressure vibration remained in the ink due to an ejection pulse, thus stabilizing ejection operation in the following print cycle.

Figure 10:
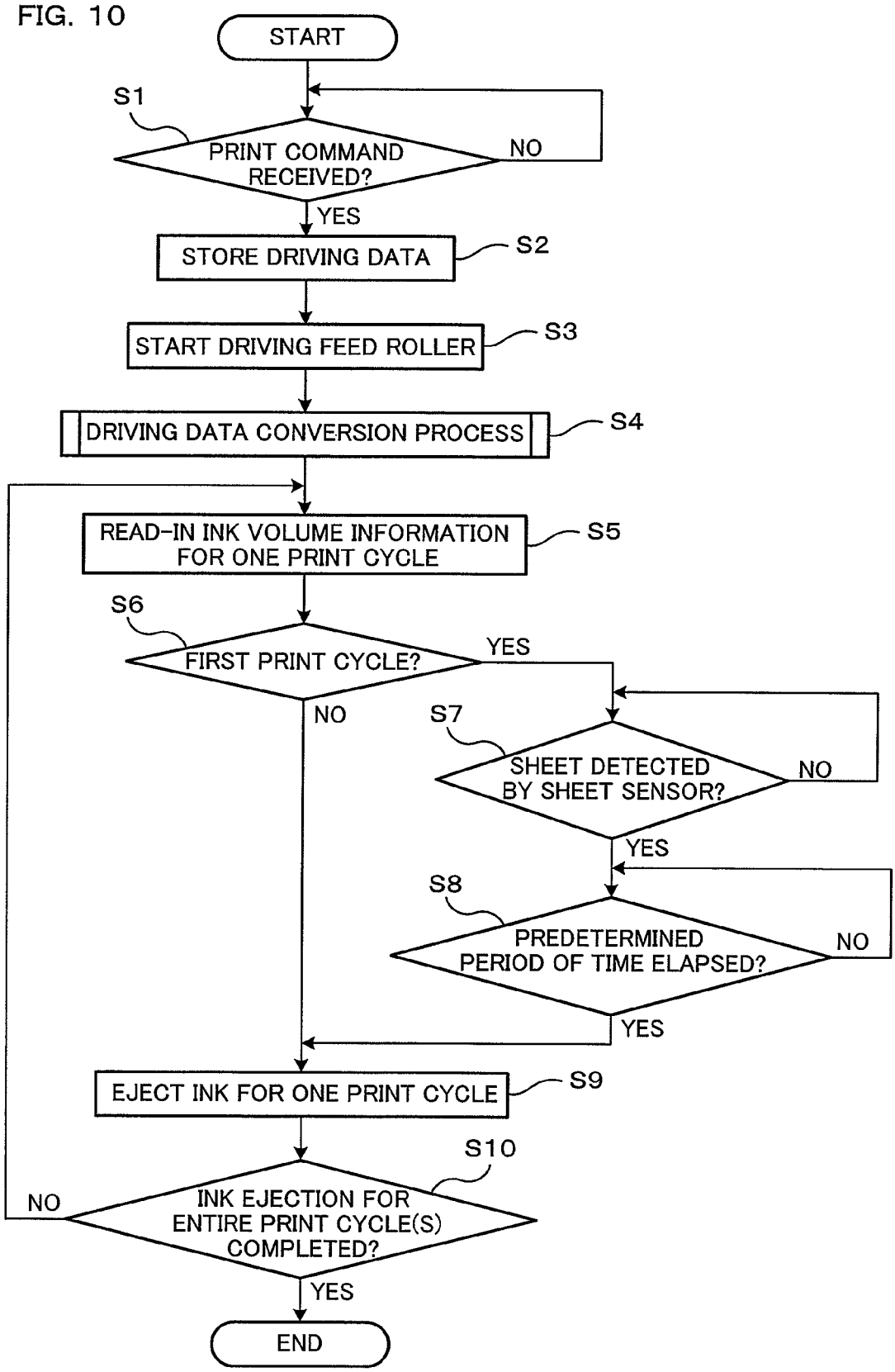
FIG. 10 is a flow chart illustrating print operation of the inkjet printer illustrated in FIG. 1.
Figure 11:
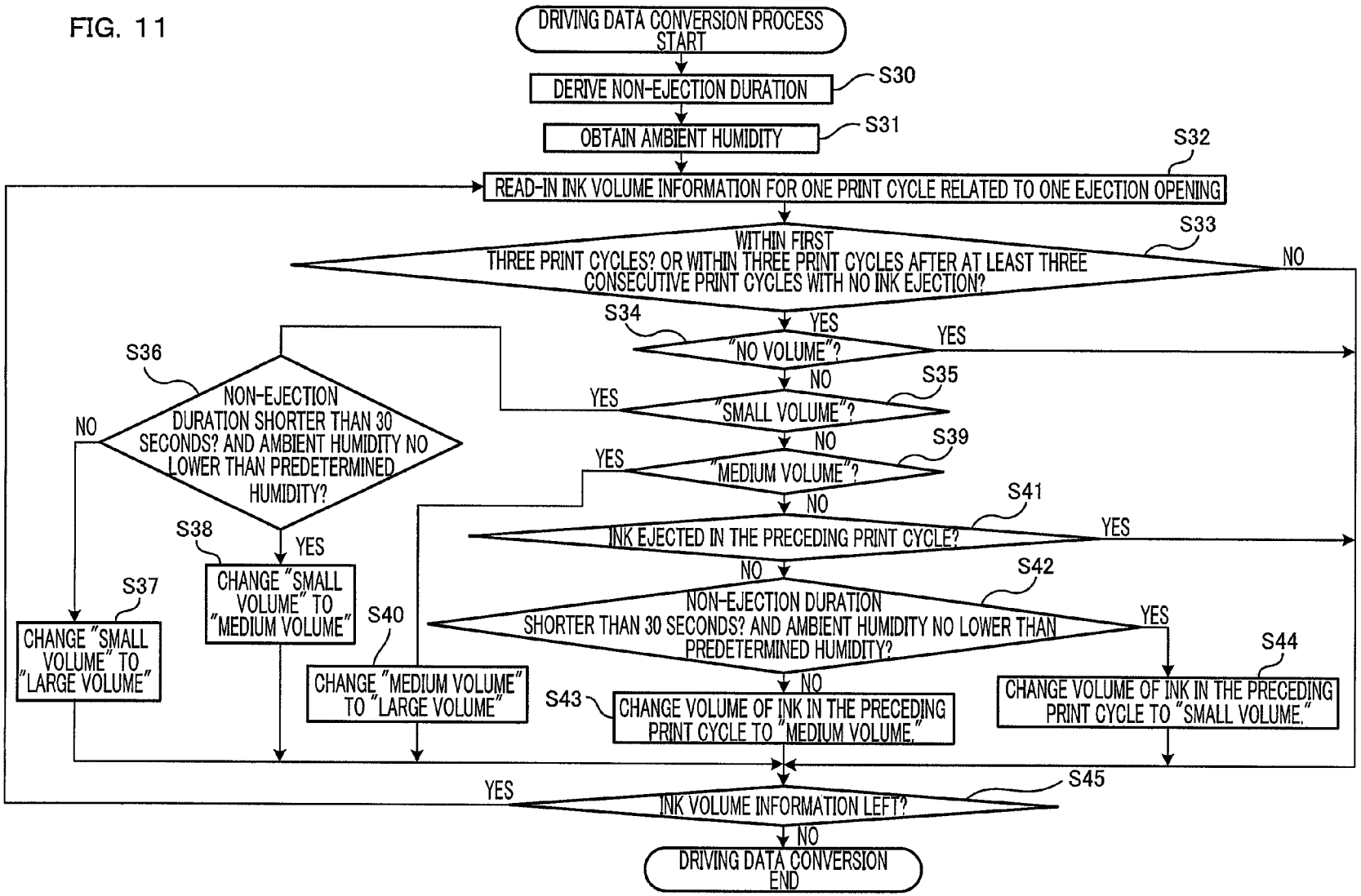
FIG. 11 is a flow chart illustrating a driving data conversion process.

The following describes a print process performed by the inkjet printer 1 according to the first embodiment, with reference to the flow charts of FIGS. 10 and 11. The following describes solely a process carried out with respect to driving data of the inkjet head 12K for the sake of convenience, without descriptions of processes carried out with respect to driving data of the inkjet heads 12M, 12C, and 12Y.

In step S1, the control unit 32 repeatedly determines whether a print command is received by a host. When a print command is received (S1: YES), driving data of the inkjet head 12K included in the print command received is stored in the storage unit 41 in step S2. Note that the print command also includes the number of sheets to be printed, layout information, and the like.

In step S3, the convey control unit 44 starts rotating the motor 36. This rotates the feed roller 25, thus starts conveyance of a sheet P. In step S4, a driving data conversion process is carried out on driving data stored in the storage unit 41. FIG. 11 illustrates the driving data conversion process in detail.

In the driving data conversion process, the non-ejection duration derivation unit 46 derives non-ejection duration in step S30. In the present embodiment, non-duration is derived as a period of time which has elapsed since the end of printing on the preceding sheet P, that is, since a period of time required to complete printing on one sheet P has elapsed after a detection signal outputted by the sheet sensor 31 indicating the leading end of the preceding sheet P is received, before a start of printing on the current sheet P, the detection signal. In step S31, the control unit 32 obtains the ambient humidity detected by the humidity sensor 73.

In step S32, the control unit 32 reads, from the storage unit 41 into the RAM, ink volume information for a print cycle related to an ejection opening 108 of the inkjet head 12K. In step S33, the control unit 32 determines whether (i) the print cycle corresponding to the ink volume information read-in (hereinafter also referred to as reference print cycle) takes place within the first three print cycles in the ejection opening 108, or (ii) the reference print cycle takes place within three cycles following at least three consecutive print cycles in which no ink is to be ejected. When it is determined that the former case or the latter case is to occur (S33: YES), the process proceeds to step S34. When it is determined that neither case is to occur (S33: NO), the process proceeds to step S45.

In step S34, the control unit 32 determines whether the volume of ink read-in is "no volume." When it is determined that the volume of ink read-in is "no volume" (S34: YES), the process proceeds to step S45 without converting the driving data. When it is determined that the volume of ink read-in is not "no volume" (S34: NO), the process proceeds to step S35.

In step S35, the control unit 32 determines whether the volume of ink read-in is "small volume." When it is determined that the volume of ink read-in is "small volume" (S35: YES), the process proceeds to step S36. In step S36, the determination unit 43 determines (i) whether the non-ejection duration derived in step S30 is shorter than thirty seconds, and (ii) whether the ambient humidity obtained in step S31 is no lower than the predetermined humidity. When it is determined that the non-ejection duration is shorter than thirty seconds, and the ambient humidity is no lower than the predetermined humidity (S36: YES), the process proceeds to step S38. When otherwise determined (S36: NO), the process proceeds to step S37. In step S37, the conversion unit 42 converts the driving data of the inkjet head 12K in such a manner that the volume of ink which is originally "small volume" is changed to "large volume," the driving data stored in the storage unit 41. The process proceeds to step S45 thereafter. In step S38, the conversion unit 42 converts the driving data in such a manner that the volume of ink is changed to "medium volume." The process proceeds to step S45 thereafter.

In step S35, when it is determined that the volume of ink read-in is not "small volume" (S35: NO), the process proceeds to step S39. In step S39, the control unit 32 determines whether the volume of ink read-in is "medium volume." When it is determined that the volume of ink read-in is "medium volume" (S39: YES), the process proceeds to step S40. In step S40, the conversion unit 42 converts the driving data in such a manner that the volume of ink which is originally "medium volume" is changed to "large volume." The process proceeds to step S45 thereafter.

When it is determined in step S39 that the volume of ink is not "medium volume" (S39: NO), the process proceeds to step S41. In step S41, the control unit 32 determines whether ink is to be ejected in a print cycle preceding the print cycle corresponding to the ink volume information read-in (reference print cycle). When it is determined that ink is to be ejected in the print cycle preceding the reference print cycle (S41: YES), the process proceeds to step S45. When it is determined that no ink is to be ejected in the print cycle preceding the reference print cycle (S41: NO), the process proceeds to step S42.

In step S42, the determination unit 43 determines (i) whether the non-ejection duration derived in step S30 is shorter than thirty seconds, and (ii) whether the ambient humidity obtained in step S31 is no lower than the predetermined humidity. When it is determined that the non-ejection duration is shorter than thirty seconds and that the ambient humidity is no lower than the predetermined humidity (S42: YES), the process proceeds to step S44. In step S44, the conversion unit 42 converts driving data so that "small volume" of ink is to be ejected in the print cycle preceding the reference print cycle. Here, when the reference print cycle is the first print cycle, "small volume" of ink is ejected in the 0-th print cycle, that is, a pixel dot is formed on the margin. In other words, the driving data is converted so as to include information on printing on the margin. The process proceeds to step S45 thereafter. When it is determined in step S42 that the non-ejection duration is equal to or longer than thirty seconds, and that the ambient humidity is lower than the predetermined humidity (S42: NO), the process proceeds to step S43. In step S43, the conversion unit 42 converts the driving data so that "medium volume" of ink is to be ejected in the print cycle preceding the reference print cycle. Here, when the reference print cycle is the first print cycle, "medium volume" of ink is ejected in the 0-th print cycle, that is, a pixel dot is formed on the margin. In other words, the driving data under the circumstance is converted so as to include information on printing on the margin. The process proceeds to step S45 thereafter.

In step S45, the control unit 32 determines whether there is any ink volume information left in the storage unit 41, which ink volume information is yet to be read-in. When it is determined that there is ink volume information yet to be read-in left in the storage unit 41 (S45: YES), the process returns to step S32. When it is determined that there is no ink volume information yet to be read-in left in the storage unit 41 (S45: NO), the driving data conversion process ends.

Then, the process returns to step S5 of FIG. 10. In step S5, the head control unit 48 reads, from the storage unit 41 into the RAM, ink volume information corresponding to one print cycle in driving data of the inkjet head 12K. In step S6 thereafter, the control unit 32 determines whether the one print cycle corresponds to the first print cycle. When it is determined that the one print cycle corresponds to the first print cycle (S6: YES), the process proceeds to step S7. In step S7, the control unit 32 repeatedly determines whether a detection signal outputted by the sheet sensor 31 is received, the detection signal indicating the leading end of a sheet P. When a detection signal is received, the process proceeds to step S8. In step S8, the process is put on idle until a predetermined period of time has elapsed, the predetermined period of time being a period of time after the leading end of the sheet P has been detected before the sheet P has reached a print position. The predetermined period of time equals a quotient obtained by dividing the distance in the conveyance direction between the sheet sensor 31 and the inkjet head 12K, by speed in which the sheet P is conveyed on the conveyor belt 28. After the predetermined period of time has elapsed, the process proceeds to step S9.

In step S9, the head control unit 48 controls the inkjet head 12K so that a volume of ink for the one print cycle is ejected through an ejection opening 108. The process proceeds to step S10 thereafter. In step S10, the control unit 32 determines whether ejection for entire print cycles has completed, with respect to driving data stored in the storage unit 41. When it is determined that ejection for the entire print cycles has not completed yet (S10: NO), the process returns to step S5. Further, when it is determined that ejection for the entire print cycles has completed (S10: YES), the print process ends.

When the temperature sensor 72 is utilized instead of the humidity sensor 73, the control unit 32 obtains the ambient temperature detected by the temperature sensor 72 in step S31. Then, in each of step S36 and step S42, the determination unit 43 determines (i) whether non-ejection duration is shorter than thirty seconds, and (ii) whether the ambient temperature obtained in step S31 is lower than the predetermined temperature. When it is determined in each of step S36 and step S42 that the non-ejection duration is shorter than thirty seconds, and the ambient temperature is lower than the predetermined temperature (S36: YES/S42: YES), the process proceeds to step S38 and step S44, respectively.

Figure 12A:
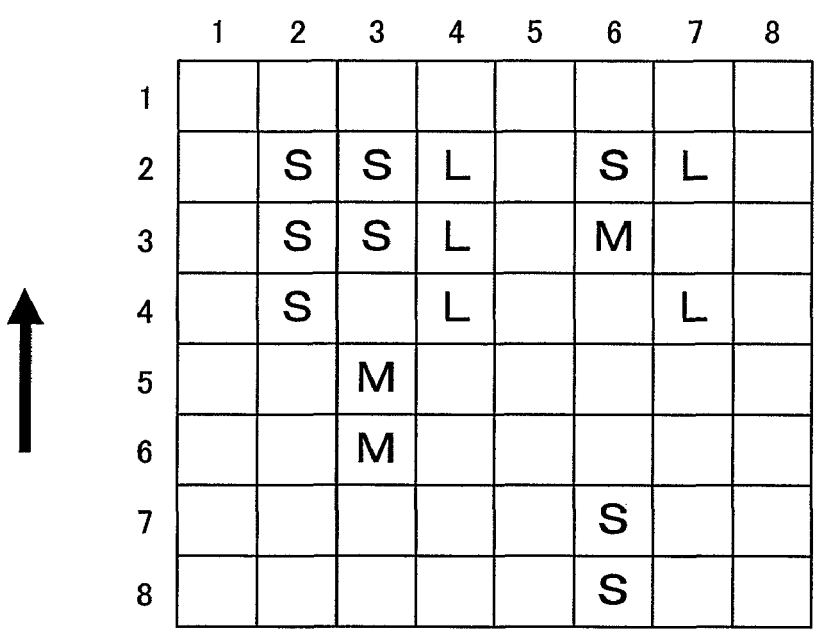
FIG. 12 concretely illustrates conversion of driving data.
Figure 12B:
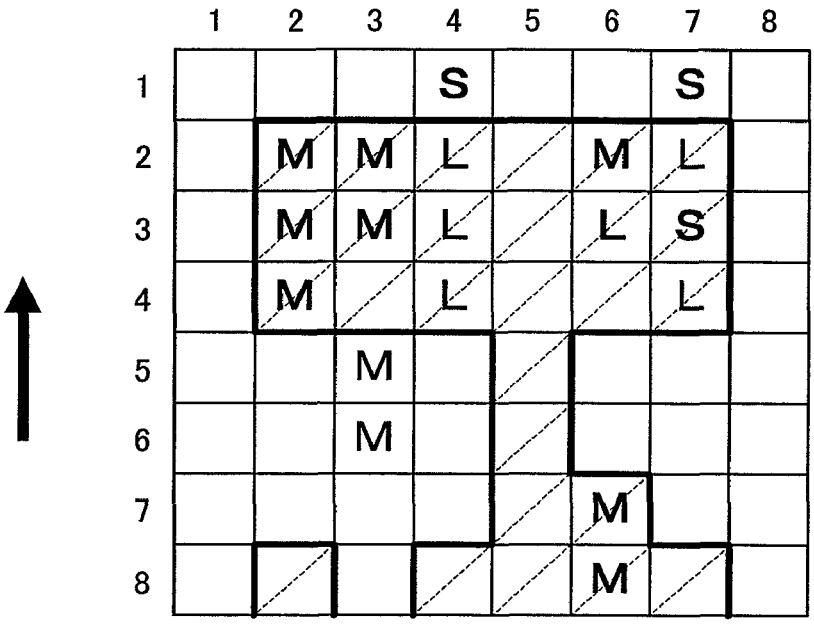

The following concretely describes conversion of driving data, with reference to FIG. 12. FIGS. 12A and 12B each illustrate the volume of ink of each of a plurality of dots formed on a sheet P. FIG. 12A illustrates a case where the driving data conversion process described in step S3 is not carried out, and FIG. 12B illustrates a case where the driving data conversion process is carried out on the same driving data as that of the printing illustrated in FIG. 12A.

Note that the non-ejection duration in this case, that is, a period of time after printing on the preceding sheet P has completed before the start of printing on the current sheet P is shorter than thirty seconds. Moreover, the ambient humidity is no lower than the predetermined humidity. Further, eight columns×eight or more rows of pixel dots can be formed on a sheet P. In other words, FIG. 12A illustrates an area in which eight columns×eight rows of pixel dots can be formed; however in actuality, eight or more rows of pixel dots can be formed on the sheet P. In FIG. 12A, the first row, the first column, and the eighth column are illustrated as a margin, thus an image is formed in an area where six columns×seven or more rows of pixel dots can be formed.

Pixel dots can be formed on the cells illustrated in FIG. 12A by ejecting ink in each print cycle through the ejection openings 108 of the inkjet head 12K. One column corresponds to one ejection opening 108. In other words, an ejection opening 108 ejects ink on any cell belonging to one column.

Hereinafter, a cell located on the x-th row from the top and the y-th column from the left is denoted by (x, y). In the example illustrated in FIG. 12A, "small volume" of ink and "large volume" of ink are respectively ejected on a cell (2, 2) and a cell (4, 7). Further, the cells into which no volume of ink is specified indicates that "no volume" of ink is to be ejected in the corresponding print cycle.

FIG. 12B illustrates a case where the driving data conversion process of step S4 is carried out on the same driving data as that related to the printing illustrated in FIG. 12A. In other words, non-ejection duration is derived in step S30 first, and the ambient temperature is obtained in step S31. Afterwards in step S32, ink volume information related to a print cycle corresponding to one cell is read-in, and a process according to the ink volume information and the like is carried out thereafter.

The cells located within the area surrounded by the heavy line in FIG. 12B correspond to print cycles where the determinations result in YES in step S33 of FIG. 11. In other words, the print cycles in which ink is to be ejected in these cells each take place within the first three cycles, or within three cycles following three or more consecutive print cycles where no ink is to be ejected. The print cycles in which ink is to be ejected in the cells located within the area are therefore subject to ink volume conversion.

The following takes the cell (2,2) as an example, the cell corresponding to a print cycle in which a determination of "YES" is made in step S33. As illustrated in FIG. 12A, the cell (2, 2) indicates "small volume." Thus, according to the ink volume information, a determination of "YES" is made in step S35, and since the non-ejection duration is shorter than thirty seconds and the humidity is no lower than the predetermined humidity, a determination of "YES" is made in step S36 thereafter. Thus, the volume of ink related to the print cycle is converted from "small volume" to "medium volume" in step S38. As a result, "medium volume" of ink is ejected to the cell (2, 2), as illustrated in FIG. 12B.

The following takes a cell (2, 4) as an example, the cell corresponding to a print cycle in which a determination of "YES" is made in step S33. As illustrated in FIG. 12A, the cell (2, 4) indicates "large volume." Thus, according to the ink volume information, a determination of "NO" is made in step S35, and a determination of "NO" is made in step S39 thereafter. Since the volume of ink indicated in a cell (1, 4) is "no volume," a determination of "NO" is made in step S41.

Further, since the non-ejection duration is shorter than thirty seconds, and the humidity is no lower than the predetermined humidity, a determination of "YES" is made in step S42. Afterwards in step S44, the volume of ink to be ejected in the print cycle proceeding the reference print cycle is specified as "small volume." As a result, as illustrated in FIG. 12B, "small volume" of ink is ejected to the cell (1, 4). In other words, "small volume" of ink is ejected on the margin of the sheet P.

According to the first embodiment described above, it is possible to put each of the ejection openings 108 in a proper state in a print cycle where "large volume"; i.e., the maximum amount of ink is to be ejected. In other words, ejection of ink in the print cycle preceding the said print cycle functions as a flusher. This prevents such a situation as decrease in volume of ink ejected in the said print cycle due to increase in viscosity which occurs in the vicinity of an ejection opening 108. Thus, high print precision is maintained.

Further, it is possible to put each of the ejection openings 108 in a proper state in a print cycle which corresponds to a start of printing and where "large volume" of ink is to be ejected. Thus, high print precision is maintained.

Further, a proper process is carried out in accordance with (i) increase in ink viscosity which occurs after printing on the preceding sheet P has completed and before printing on one sheet P begins, or (ii) increase in ink viscosity which occurs due to successive periods where no ink is to be ejected during printing on the one sheet P. This improves print precision.

Further, for each of the ejection openings 108, it is assumed that the volume of ink to be ejected in a print cycle comes to be less than a desired volume, in which print cycle "small volume" or "medium volume" of ink is to be ejected. Thus, a volume of ink larger than the original volume of ink is to be ejected in the print cycle through each of the ejection openings 108. As a result, the volume of ink approximates a desired volume of ink. Thus, high print precision is maintained.

Further, for each of the ejection openings 108, when the non-ejection duration is no shorter than thirty seconds, that is, when it is highly possible that the viscosity of the ink has increased, a volume of ink to be ejected in the print cycle preceding a print cycle where "large volume" of ink is to be ejected is set to be larger than a volume of ink to be ejected in a case where the non-ejection duration is shorter than thirty seconds. This allows flushing operation with a more proper volume of ink. Thus, an ejection opening 108 is put in a more proper state in the print cycle where "large volume" of ink is to be ejected. Further, for each of the ejection openings 108, when non-ejection duration is no shorter than thirty seconds, a volume of ink to be ejected in a print cycle where "small volume" of ink is to be ejected is converted to a volume of ink larger than one which is ejected in a case where the non-ejection duration is shorter than thirty seconds. Thus, high print precision is maintained.

Further, when the determination unit 43 is capable of elongating the predetermined period of time as the ambient humidity received from the humidity sensor 73 increases, the determination unit 43 takes more into account the fact that the viscosity of ink is less likely to increase as the ambient humidity increases. In other words, the predetermined period of time can be properly set in accordance with the increasableness of the viscosity of the ink, which predetermined period of time is a criterion of: (i) a determination of whether "small volume" or "medium volume" of ink is to be ejected in the print cycle preceding a print cycle where "large volume" of ink is to be ejected; and (ii) a determination of whether to convert the volume of ink to be ejected in a print cycle to "medium volume" or "large volume," in which print cycle "small volume" of ink is to be originally ejected. Thus, high print precision is maintained.

Further, driving data is converted in such manners that: (i) when the determination unit 43 determines that the ambient humidity is no lower than the predetermined humidity, "medium volume" of ink is to be ejected instead in a print cycle where "small volume" of ink is to be ejected; and (ii) when the determination unit 43 determines that the ambient temperature is lower than the predetermined humidity, "large volume" of ink is to be ejected in the print cycle. Thus, in accordance with the ambient humidity, that is, in accordance with the increasableness of the viscosity of the ink, the volume of ink to be ejected in a print cycle approximates to a more desired volume, in which print cycle "small volume" of ink is to be ejected. Further, driving data is converted in such manners that: (i) when the determination unit 43 determines that the ambient humidity is no lower than the predetermined humidity, "small volume" of ink is to be ejected in a print cycle preceding a print cycle where "large volume" of ink is to be ejected; and (ii) when the determination unit 43 determines that the ambient humidity is lower than the predetermined humidity, "medium volume" of ink is to be ejected in the preceding print cycle. This puts an ejection opening 108 into a more proper state in a print cycle where "large volume" of ink is to be ejected. Thus, high print precision is maintained.

Further, when the determination unit 43 is capable of elongating the predetermined period of time as the ambient temperature received from the temperature sensor 72 decreases, the determination unit 43 takes more into account the fact that the viscosity of ink is less likely to increase as the ambient temperature decreases. In other words, the predetermined period of time is properly set in accordance with increasableness of the viscosity of the ink, which predetermined period of time is a criterion of: (i) a determination of whether "small volume" or "medium volume" of ink is to be ejected in a print cycle preceding a print cycle where "large volume" of ink is to be ejected; and (ii) whether to convert the volume of ink to be ejected in a print cycle to "medium volume" or "large volume," in which print cycle "small volume" of ink is to be originally ejected. Thus, high print precision is maintained.

In such a case where the temperature sensor 72 is utilized, driving data is converted in such manners that: (i) when the determination unit 43 determines that the ambient temperature is lower than the predetermined temperature, "medium volume" of ink is to be ejected instead in a print cycle where "small volume" of ink is to be ejected; and (ii) when the determination unit 43 determines that the ambient temperature is no lower than the predetermined temperature, "large volume" of ink is to be ejected instead in the print cycle. This allows the volume of ink to be ejected in a print cycle to approximate to a more desired volume, in which print cycle "small volume" of ink is to be ejected, in accordance with the ambient temperature; i.e., the increasableness of the viscosity of the ink. Further, driving data is converted in such manners that: (i) when the determination unit 43 determines that the ambient temperature is lower than the predetermined temperature, "small volume" of ink is to be ejected instead in a print cycle preceding a print cycle where "large volume" of ink is to be ejected; and (ii) when the determination unit 43 determines that the ambient temperature is no lower than the predetermined temperature, "medium volume" of ink is to be ejected instead in the print cycle. This puts an ejection opening 108 into a more proper state in a print cycle where "large volume" of ink is to be ejected. Thus, high print precision is maintained.

The following describes a second embodiment which adds changes to the first embodiment, with reference to FIG. 13. Note however that the same members as those in the first embodiment are respectively denoted by the same reference numerals, without description thereof.

In the second embodiment, the convert instruction unit 47 instructs the conversion unit 42 to convert driving data so that object data included in the driving data is converted, which object data corresponds to: (i) each of print cycles where a cumulative ejection number is equal to or less than a third predetermined number, the cumulative ejection number being the number of previous print cycles, after the start of printing onto a sheet P, in each of which print cycles a volume of ink other than "no volume" is to be ejected; or (ii) each of the first predetermined number of print cycles following the second predetermined number of consecutive print cycles where no ink is to be ejected. As the first embodiment, the second predetermined number is "three" and the third predetermined number is "three" in the second embodiment.

In other words, in the second embodiment, a step alternative to step S33 of FIG. 11 is carried out. In the alternative step, the control unit 32 determines whether the print cycle corresponding to the ink volume information read-in is a print cycle: (i) where the cumulative ejection number is equal to or less than three, or (ii) which takes place within three print cycles from the print cycle following three or more consecutive print cycles where no ink is to be ejected. As mentioned above, the cumulative ejection number is a number of previous print cycles, after the start of printing onto a sheet P, in each of which print cycles a volume of ink other than "no volume" is to be ejected. When the control unit 32 determines that the print cycle is a print cycle (i) where the cumulative ejection number is equal to or less than 3, or (ii) which takes place within three print cycles from the print cycle following three or more print cycles where no ink is to be ejected, the process proceeds to step S45.

Figure 13A:
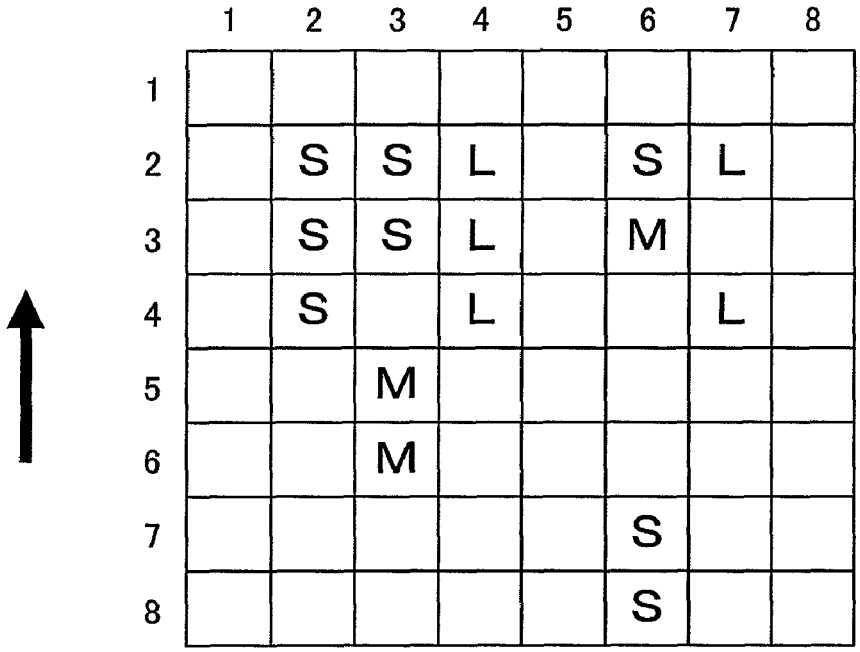
FIG. 13 concretely illustrates conversion of driving data.
Figure 13B:
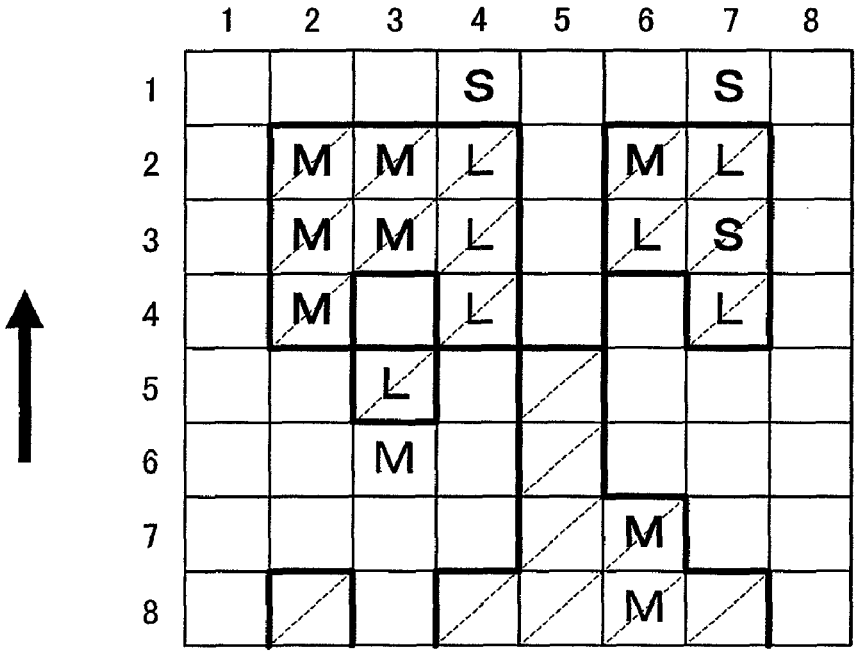

The following concretely describes conversion of driving data with reference to FIG. 13. FIGS. 13A and 13B each illustrate the volume of ink of each of the plurality of dots formed on a sheet P, as FIG. 12. FIG. 13A illustrates a case where the driving data conversion process of step S4 is not carried out. FIG. 13B illustrates a case where the driving data conversion process is carried out on the driving data same as the driving data of the printing illustrated in FIG. 13A. Under such a circumstance, non-ejection duration is set to be shorter than thirty seconds, and the ambient humidity is equal to or higher than the predetermined humidity, as in the first embodiment.

The cells located within the area surrounded by the heavy line in FIG. 13B corresponds to print cycles in each of which a determination of "YES" is made in the step alternative to step S33. In other words, each of the print cycles in which ink is to be ejected in these cells is a print cycle: (i) where the cumulative ejection number is equal to or less than three; or (ii) which takes place within three print cycles from the print cycle following three or more consecutive print cycles where no ink is to be ejected. The print cycles in which ink is to be ejected in these cells are therefore subject to ink volume conversion.

A cell (5, 3) of FIG. 13A, for example, indicates "medium volume" of ink. Suppose that the ink volume information is read-in in step S32, and the process proceeds to the step alternative to step S33. In this step, it is determined with respect to an ejection opening 108 corresponding to the ink volume information that a print cycle corresponding to the ink volume information is a print cycle where the cumulative ejection number is equal to or less than three. Specifically, as illustrated in FIG. 13A, the cumulative ejection number is two: cells (2, 3) and (2, 4). Thus, a determination of "YES" is made with respect to the print cycle in the step alternative to step S33, and the process proceeds to step S34 thereafter.

In step S34, a determination is made that the volume of ink read-in is not "no volume," and the process proceeds to step S35. In step S35, a determination is made that the volume of ink read-in is not "small volume," and the process proceeds to step S39. In step S39, a determination is made that the volume of ink read-in is "medium volume," and the process proceeds to step S40. In step S40, the volume of ink in the reference print cycle is converted from "medium volume" to "large volume." As a result, "large volume" of ink is ejected in the cell (5, 3) as illustrated in FIG. 13B.

In the second embodiment described above, a proper process is carried out in accordance with (i) increase in the viscosity of the ink caused after printing on the preceding sheet P has completed before printing on one sheet P begins, or (ii) increase in the viscosity in the ink caused in the event when a period of time endures in which no ink is ejected in printing on the one sheet P. This improves print precision.

Note that the first predetermined number, the second predetermined number, and the third predetermined number are not limited to "three." Further, the predetermined period of time required for a determination made by the determination unit 43 is not limited to thirty seconds.

Further, in the above mentioned embodiments, the volume of ink to be ejected through each of the ejection openings 108 is one of "large volume," "medium volume," and "small volume"; however, the volume of ink is not limited thereto. In other words, a volume of ink other than these volumes of ink may be employed.

Further, a print cycle which is subject to ink volume conversion may be only one of: (i) a print cycle which takes place within the first three print cycles; (ii) a print cycle where the cumulative ejection number is equal to or less than a third predetermined number; and (iii) a print cycle which takes place within three print cycles following the print cycle following three or more consecutive print cycles in which no ink is to be ejected.

Further, in the above embodiments, the determination unit 43 determines, in each of the steps S36 and S42, whether the non-ejection duration derived is shorter than the predetermined period of time, and whether the ambient humidity obtained is no lower than the predetermined humidity. Note however that the determination unit 43 may only determine whether the non-ejection duration derived is shorter than the predetermined period of time. Alternatively, the determination unit 43 may only determine whether the ambient temperature obtained is no lower than the predetermined humidity.

In the above embodiment, when the inkjet head 12K is provided with ejection openings 108 arranged so as to allow marginless printing on a sheet P, two ejection openings 108 have no occasion at all to eject ink during a series of print processes, the two ejection openings 108 respectively corresponding to two columns on both sides of the sheet P. Here, periodic flushing processes may be carried out with respect to the two ejection openings 108. In the flushing process, a "small volume" ink droplet is ejected onto the sheet P for each predetermined period of time. In view of maintaining print quality, the volume of an ink droplet to be ejected during the flushing process is preferably smaller than "small volume." Such an ink droplet is obtainable by decreasing the pulse width of the pulses illustrated in FIG. 8C. Further, in view of maintaining an ink ejection characteristic of the two ejection openings 108 with the flushing process, the predetermined period of time, for example, may be thirty seconds or shorter, which two ejection openings 108 are respectively located on both sides of the inkjet head 12K.

In the above embodiments, the feed roller begins moving when the driving data conversion process has completed; however, the order of occurrence may be reversed.

Note that in the above embodiments, the liquid to be ejected through the ejection openings 108 is ink. However, the present invention is applicable to a liquid other than ink as long as it increases its viscosity as time elapses. Further, an liquid ejection head utilizing PZT is described as an example of an inkjet head. However, the present invention is applicable to an electrostatic liquid ejection head, or a liquid ejection head utilizing bubbles generated by heating up the liquid.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image forming apparatus comprising:

a conveyance mechanism which conveys a recording medium;

a liquid ejection head which has a plurality of ejection openings positioned at predetermined intervals in a perpendicular direction perpendicular to a conveyance direction in which a recording medium is conveyed by the conveyance mechanism, each of the intervals corresponding to a print resolution in the perpendicular direction;

a driving data storage which stores therein driving data of the liquid ejection head, the driving data indicating a volume of liquid to be ejected through each of the ejection openings in each print cycle in printing onto one recording medium, the volume of liquid selected from a plurality of different predetermined volumes of ink including "zero," and the print cycle corresponding to a period required for the conveyance mechanism to convey a recording medium for a unit distance corresponding to a print resolution in the conveyance direction;

a converter which converts the driving data stored in the driving data storage so that, in each of the ejection openings, when a volume of liquid to be ejected in an (m+1)-th print cycle following an m-th print cycle in which no liquid is to be ejected is a maximum volume of ink among the predetermined volumes, the volume of liquid to be ejected in the m-th print cycle being one of the predetermined volumes other than "zero" and the maximum volume, "m" being an integer number no less than "0";

a convert instructor which instructs the converter, in a switchable manner, whether to convert the driving data; and a head controller which controls the liquid ejection head so that each volume of liquid is ejected through each of the ejection openings, based on the driving data stored in the driving data storage including the driving data converted by the converter.

2. The image forming apparatus according to claim 1, wherein the converter converts the driving data stored in the driving data storage so that, in each of the ejection openings, when a volume of liquid to be ejected in a print-start cycle is the maximum volume, volume of liquid other than "zero" and the maximum volume is to be ejected immediately before the print-start cycle, the print-start cycle being a print cycle corresponding to a start of printing onto the one recording medium.

3. The image forming apparatus according to claim 1, wherein the convert instructor instructs the converter to convert the driving data so that object data included in the driving data is converted, the object data corresponding to (i) each print cycle within a first predetermined number of print cycles from the print-start cycle or (ii) each print cycle within a first predetermined number of print cycles from a print cycle following a second predetermined number of continuous print cycles in which no liquid is to be ejected.

4. The image forming apparatus according to claim 3, wherein the converter converts the driving data stored in the driving data storage so that, in each of the ejection openings, when a volume of liquid to be ejected in a n-th print cycle is other than "zero" and the maximum volume, the volume of liquid to be ejected in the n-th print cycle is greater than an original volume, "n" being a natural number.

5. The image forming apparatus according to claim 4, wherein the converter converts the driving data stored in the driving data storage so that the volume of liquid to be ejected in the n-th print cycle is one level greater than the original volume.

6. The image forming apparatus according to claim 1, further comprising:

a non-ejection duration deriver which derives non-ejection duration in each of the ejection openings, the non-ejection duration being a period of time from a last ejection through the ejection opening before each of the print cycles in printing onto the one recording medium begins; and a first determiner which determines whether non-ejection duration derived by the non-ejection duration deriver is no less than a predetermined period of time, wherein the converter converts the driving data stored in the driving data storage so that, in each of the ejection openings, when the first determiner determines that the non-ejection duration is less than the predetermined period of time, the volume of liquid to be ejected in the m-th print cycle is a first predetermined volume, and when the first determiner determines that the non-ejection duration is no less than the predetermined period of time, the volume of liquid to be ejected in the m-th print cycle is a second predetermined volume, the first predetermined volume being other than "zero" and the maximum volume, and the second predetermined volume being other than the maximum volume and greater than the first predetermined volume.

7. The image forming apparatus according to claim 6, wherein the non-ejection duration is a time which has elapsed since an end of printing onto a recording medium immediately before the one recording medium.

8. The image forming apparatus according to claim 7, further comprising:

a humidity detector which detects humidity around the liquid ejection head, wherein the first determiner sets the predetermined period of time so that the predetermined period of time increases as the humidity detected by the humidity detector increases.

9. The image forming apparatus according to claim 8, further comprising:

a second determiner which determines whether the humidity detected by the humidity detector is no less than predetermined humidity, wherein the converter converts the driving data stored in the driving data storage so that, in each of the ejection openings, when the second determiner determines that the humidity is no less than the predetermined humidity, the volume of liquid to be ejected in the n-th print cycle is a third predetermined volume, and when the second determiner determines that the humidity is less than the predetermined humidity, the volume of liquid to be ejected in the n-th print cycle is a fourth predetermined volume, the third volume being other than the maximum volume and greater than the original volume, and the fourth predetermined volume being greater than the third volume.

10. The image forming apparatus according to claim 6, further comprising:

a temperature detector which detects temperature around the liquid ejection head, wherein the first determiner sets the predetermined period of time so that the predetermined period of time increases as the temperature detected by the temperature detector decreases.

11. The image forming apparatus according to claim 10, further comprising:

a third determiner which determines whether the temperature detected by the temperature detector is no less than predetermined temperature, wherein the converter converts the driving data stored in the driving data storage so that, in each of the ejection openings, when the third determiner determines that the temperature is less than the predetermined temperature, the volume of liquid to be ejected in the n-th print cycle is a fifth predetermined volume, and when the third determiner determines that the temperature is no less than the predetermined temperature, the volume of liquid to be ejected in the n-th print cycle is a sixth predetermined volume, the fifth predetermined volume being other than the maximum volume and greater than the original volume, and the sixth predetermined volume being greater than the fifth predetermined volume.

* * * * *